United States Patent [19]

Shepherd

[11] 4,335,300

[45] Jun. 15, 1982

[54] DIET CONTROL APPARATUS AND METHOD

[76] Inventor: William C. Shepherd, 725 Palomares Ave., San Dimas, Calif. 91773

[21] Appl. No.: 181,867

[22] Filed: Aug. 27, 1980

[51] Int. Cl.[3] ..... G06C 1/00

[52] U.S. Cl. ..... 235/123

[58] Field of Search ..... 235/18, 68, 90, 123; 35/33

[56] References Cited

U.S. PATENT DOCUMENTS 815,174 3/1906 Janes ..... 235/123

2,555,781 6/1951 Bristol ..... 235/123

FOREIGN PATENT DOCUMENTS 400890 10/1909 France ..... 235/123

*Primary Examiner*—L. T. Hix

*Assistant Examiner*—Benjamin R. Fuller

*Attorney, Agent, or Firm*—Boniard I. Brown

[57] ABSTRACT

Apparatus for recording and visually indicating the consumption of nutrients which includes a frame having first and second elongated members disposed in spaced relationship and a plurality of wires intermediate the first and second members which are in generally mutually parallel relationship. A plurality of beads is carried on each of the wires and a blocking member is provided for constraining the beads on each wire from moving past an arbitrary line defining first and second axial sections of each of the wires. The frame includes members disposed in generally rectangular relationship, and the first and second members of the frame may be disposed in generally parallel relationship. The frame may include a box having a hinged cover.

4 Claims, 4 Drawing Figures

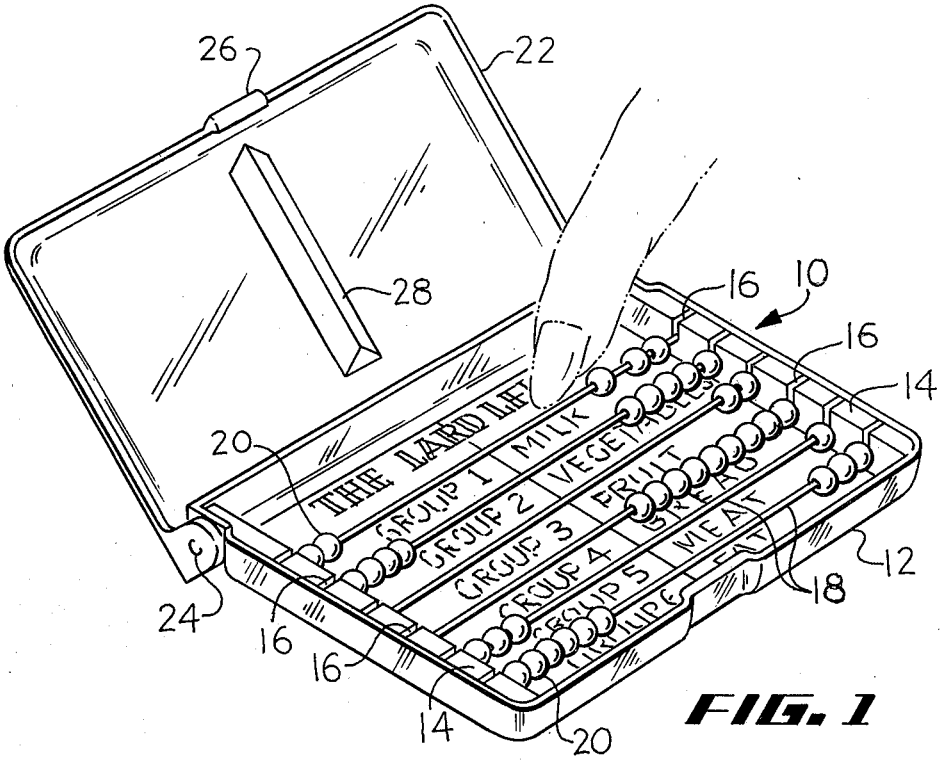
FIG. 1
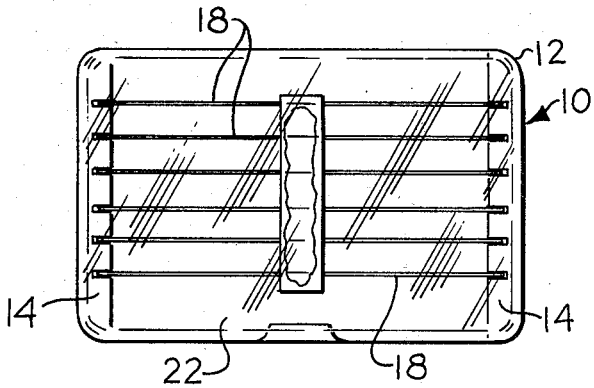
FIG. 2
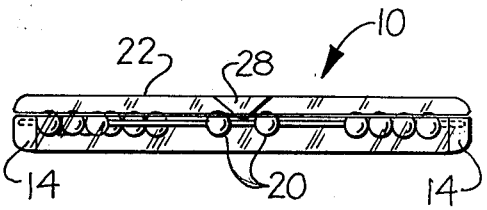
FIG. 3
| ARRANGEMENTS | (a) | (b) | (k) |
|---|---|---|---|
| GROUP 1 - MILK | ○○ | ○○ | ○○○ |
| GROUP 2 - VEGS. | ○ | ○ | ○ |
| GROUP 3 - FRUIT | ○○ | ○○○ | ○○○○ |
| GROUP 4 - BREAD | ○ | ○○ | ○○○○○○ |
| GROUP 5 - MEAT | ○○○○○ | ○○○○○ | ○○○○○○ |
| GROUP 6 - FAT | | | ○○○○○ |
FIG. 4

DIET CONTROL APPARATUS AND METHOD

BACKGROUND OF THE INVENTION

The invention relates to diet control apparatus. There is a large demand for dieting aids. The demand has been stimulated by continuing public interest in improved physical appearance, greater longevity, generally better health, and other factors. The prior art includes various forms and the like for recording the consumption of calorie intake. Such apparatus has not been wholly satisfactory primarily because they have not been convenient to use either because the apparatus failed to adequately differentiate between protein, carbohydrates or fats or because the apparatus was relatively complex to operate.

It is an object of the invention to provide apparatus which enables the user to record and provide a display indicating the consumption of protein, carbohydrates and fats which is convenient to use and which provides a visual display which may be conveniently and rapidly interpreted.

Another object of the invention is to provide apparatus which is easy to use and does not require the use of any discrete pencil, pen, or other separate implement to utilize the invention.

Yet another object of the invention is to provide apparatus which is compact.

Still another object of the invention is to provide apparatus which may be easily and inexpensively manufactured.

SUMMARY OF THE INVENTION

The foregoing objects and other objects and advantages which shall become apparent from the detailed description of the preferred embodiment are attained in a diet control apparatus having a frame which comprises first and second elongated members disposed in spaced relationship and a plurality of wires intermediate the first and second members in generally mutually parallel relationship. A plurality of beads is carried on each of the wires and means are provided for constraining the beads on each wire from moving past an arbitrary line defining first and second axial sections of each of the wires.

The frame may include members disposed in generally rectangular relationship, and the first and second members of the frame are disposed in generally parallel relationship. The frame may comprise a box having a hinged cover. The means for constraining may comprise an element carried on the cover configured so as to interfere with the axial movement of the beads on the wires when the cover is closed. The means for constraining may comprise a resilient member carried on the cover and may be elongated and disposed in generally transverse relationship to the plurality of wires. The means for constraining may comprise a sponge rubber member having a generally triangular cross section having an apex thereof disposed more remote from the cover than the remainder of the means for constraining. In some forms of the invention the beads on at least some of the wires have a different color than the color of the beads on other wires.

The invention also includes the method for recording and displaying nutrient consumption which includes providing a frame which comprises first and second elongated members in generally mutually parallel relationship; providing wires intermediate the members; providing a plurality of beads on each of the wires; providing means for constraining the beads; and positioning the beads along the axial extent of each wire to represent dietary consumption of various nutrients.

BRIEF DESCRIPTION OF THE ACCOMPANYING DRAWING

FIG. 1 is a perspective view of the apparatus in one form of the invention, illustrating the manner of use with the cover open;

FIG. 2 is a plan view of the apparatus of FIG. 1 with the cover closed;

FIG. 3 is an elevational view of the apparatus of FIG. 1 illustrating in greater detail the manner of operation of the means for constraining the beads used therein; and FIG. 4 is a broken away chart illustrating the manner of utilization of the apparatus of FIG. 1.

DESCRIPTION OF THE PREFERRED EMBODIMENT

The apparatus is based on four basic conclusions which are as follows:

FIRST

About 15 calories per day are required per pound of body weight to maintain that weight.

SECOND

You have to reduce your intake by about 600 calories per day in order to lose an average of one pound per week.

THIRD

For safety and effectiveness, any diet must contain a balance of the six basic food elements (i.e., milk, vegetables, fruit, bread, meat, and fat).

FOURTH

Before starting any weight plan, a physician should be consulted, especially so by any person with known medical problems or those who are extremely overweight.

In order to systematically approach dietary control, somewhat arbitrarily selected groups of food such as Group IV (the bread group) have been defined and judgments made as to quantities of specific foods which have substantially equal quantities of calories, carbohydrates, protein, and fat. In the example noted, it has been determined that one half cup of cooked cereal is substantially equal to one slice of bread. This has arbitrarily been selected as one unit. Each unit is arbitrarily represented by one bead in the apparatus and method in accordance with the invention.

Based on the above noted postulates that about 15 calories per day are required per pound of body weight to maintain that weight and that the caloric intake must be reduced to about 600 calories per day in order to lose an average of one pound per week, each individual can determine the total calories which he will ordinarily require to maintain his weight as well as to lose a predetermined amount in a predetermined period. For any given quantity of calories per day, there is some generally acceptable distribution of consumption of milk, vegetables, fruit, bread, meat and fat. With this information as a background, the chart illustrated in FIG. 4 has been prepared. The chart of FIG. 4 has a plurality of vertical columns representing various total calorie intakes. The bead representations in the first column designated by the letter (a) may represent a satisfactory diet for a person of one weight which would provide a balanced diet without any loss in weight. For another person who is initially heavier the total calorie count, given the same balanced diet, will result in loss of weight at a rate which may be roughly estimated.

Any person using the apparatus in accordance with the invention will locate and refer back periodically to a given column, such as column (a), which will represent a dietary program which will achieve his goals i.e., either to stabilize his weight and provide a balanced diet or to lose weight with a balanced diet. The chart illustrated in FIG. 4 will ordinarily be supplied with or fixed to the dietary apparatus 10 illustrated in FIGS. 1, 2, and 3.

The apparatus includes, in a preferred form, a generally rectangular box 12 having two side members 14 disposed in generally parallel spaced relationship. The members 14 may be secured by an adhesive (not shown) or may be molded integrally with the box, and has a plurality of slots 16. The slots 16 in each member 14 will ordinarily be uniformly spaced, not only with respect to each other, but also with respect to the axial extremities 14, 14. A rigid wire 18 will extend from each slot 16 in each member 14 to a corresponding slot 16 in the other member 14. A plurality of beads 20 will be carried on each wire 18.

The apparatus includes a cover 22 which is connected by hinges 24 (one shown) to the rectangular box 12. A latch 26 cooperates with the rectangular box 12 to provide positive closure. The cover 22 and rectangular box 12 ordinarily will be manufactured of a transparent plastic material such as an acrylic. The members 14 may be manufactured of a plastic material also, although ordinarily some greater flexibility will be desired.

A generally triangular shaped element 28 may be molded of the same material integrally with the rest of the cover 22, or it may be fabricated of foam rubber or the like and affixed to the cover 22. The element 28, with cover 22 closed, constrains or blocks beads 20 from moving past a predetermined line defined by the element, and from sliding from one axial section of a wire 18 to the other. Each wire is designated by a legend indicating the group e.g. milk, vegetables, etc. to which it relates.

In utilizing the device, the user opens the cover to position the beads as desired on each occasion. After once making any adjustment of the beads (after consuming food) the cover 22 is closed to prevent movement of any beads 20 from one side to the other, and from one axial section of a wire to the other.

The user will initially place all the beads on one side of the constraining member 28 and move them to the other side as food is consumed during the day. It will be understood that the person will initially install a number of beads 20 on each wire 18 corresponding to the total number of beads which the selected column of the chart illustrated in FIG. 4 indicates he should consume in any one day. Since the slots 16 are dimensioned to allow easy removal of the wires 18, it will be seen that it is easy for the individual user to customize the apparatus for his particular dietary requirements.

In various embodiments of the invention the wires 18 may be disposed in parallel or perpendicular relationship to the hinge axis for the cover 22. In each embodiment the constraining member 28 will be orientated in generally perpendicular relationship to the wires 18.

It will thus be seen that the apparatus in accordance with the invention facilitates a very simple means for displaying and hence controlling the dietary habits of the user. It will be further seen that it may be manufactured easily and inexpensively.

The invention has been described with reference to its illustrated preferred embodiment. Persons skilled in the art of constructing diet recording devices may, upon exposure to the teachings herein, conceive variations in the mechanical development of the components therein. Such variations are deemed to be encompassed by the disclosure, the invention being delimited only by the appended claims.

I claim:

1. Apparatus for recording and visually indicating the consumption of various nutrients which comprises:

a box having first and second elongated members disposed in spaced relationship, said box including a plurality of members disposed in generally rectangular relationship, first and second members of said plurality of members being disposed in generally parallel relationship;

a cover maintained on said box and movable between open and closed positions;

a plurality of wires intermediate said first and second members in generally mutually parallel relationship;

a plurality of beads carried on each of said wires, each bead having a central aperture engaging a wire, said apertures and said wires being dimensioned to allow free movement of each bead on the wire on which it is mounted; and means for constraining said beads on each wire from moving past a predetermined line defining first and second axial sections of each of said wires, said means for constraining comprises a member carried on said cover and configured to prevent axial movement of said beads on said wires past said line only when said cover is closed, said means for constraining allowing free movement of said beads when said cover is open.

2. The apparatus as described in claim 1, wherein:

said means for constraining comprises an element carried on said cover, said element being elongated and disposed in generally transverse relationship to said wires.

3. The apparatus as described in claim 2, wherein:

said means for constraining comprises an element having a generally triangular cross-section with an apex remote from said cover.

4. The apparatus as described in claim 3, wherein:

said beads on at least some of said wires have a different color than the color of said beads on other wires.

* * * * *